US011814949B2

(12) United States Patent
Hoheisel et al.

(10) Patent No.: US 11,814,949 B2
(45) **Date of Patent: *Nov. 14, 2023**

(54) DOWN-HOLE TOOLS COMPRISING LAYERS OF MATERIALS AND RELATED METHODS

(71) Applicant: Baker Hughes Oilfield Operations LLC, Houston, TX (US)

(72) Inventors: Dominik Hoheisel, Lower Saxony (DE); Thomas Kruspe, Wietzendorf (DE)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/820,329

(22) Filed: Aug. 17, 2022

(65) Prior Publication Data

US 2023/0003116 A1 Jan. 5, 2023

Related U.S. Application Data

(63) Continuation of application No. 16/938,384, filed on Jul. 24, 2020, now Pat. No. 11,434,747.

(51) Int. Cl.
*E21B 47/01* (2012.01)

(52) U.S. Cl.
CPC ..... *E21B 47/01* (2013.01)

(58) Field of Classification Search
CPC ..... E21B 17/20; E21B 19/22; E21B 47/01; E21B 17/10; E21B 47/06; E21B 47/10; E21B 47/107
See application file for complete search history.

(56) References Cited

U.S. PATENT DOCUMENTS 4,850,450 A 7/1989 Hoyle et al.
5,563,512 A * 10/1996 Mumby ..... E21B 47/017 324/369

(Continued)

FOREIGN PATENT DOCUMENTS

EP 3051615 A1 8/2016
WO 2018/091543 A1 5/2018
WO 2019/018552 A1 1/2019

OTHER PUBLICATIONS

International Search Report for International Application No. PCT/US2021/042359 dated Nov. 5, 2021, 4 pages.

(Continued)

*Primary Examiner* — Caroline N Butcher
(74) *Attorney, Agent, or Firm* — TraskBritt

(57) ABSTRACT

A down-hole tool includes at least one wall. The at least one wall may include a plurality of joined substantially parallel layers of material, a plurality of pockets defined within the at least one wall, each pocket of the plurality of pockets including a plurality of openings formed in consecutive layers of the plurality of joined substantially parallel layers of material, and a plurality of recesses defined within the at least one wall and between layers of the plurality of joined substantially parallel layers of material, the plurality of recesses defining at least one conduit. The down-hole tool also includes at least one electronic component disposed within a pocket of the plurality of pockets and at least one electrical connection disposed within the at least one conduit.

21 Claims, 7 Drawing Sheets

(56) References Cited

U.S. PATENT DOCUMENTS

| | | | | |
|---|---|---|---|---|
| 6,296,066 | B1 | 10/2001 | Terry et al. | |
| 6,429,653 | B1 | 8/2002 | Kruspe et al. | |
| 6,588,267 | B1 | 7/2003 | Bradley | |
| 6,614,229 | B1 | 9/2003 | Clark et al. | |
| 6,710,600 | B1 | 3/2004 | Kopecki et al. | |
| 7,775,099 | B2 | 8/2010 | Bogath et al. | |
| 8,264,228 | B2 | 9/2012 | Bittar et al. | |
| 8,651,192 | B2 | 2/2014 | Ravensbergen | |
| 8,763,702 | B2 | 7/2014 | Peter | |
| 9,057,247 | B2 | 6/2015 | Kumar et al. | |
| 9,181,798 | B2 | 11/2015 | Palaghita et al. | |
| 9,372,124 | B2 | 6/2016 | Schlosser | |
| 9,541,447 | B2 | 1/2017 | Daton-Lovett | |
| 9,784,099 | B2 | 10/2017 | Kale et al. | |
| 10,167,683 | B2 | 1/2019 | Logan et al. | |
| 2010/0038076 | A1 | 2/2010 | Spray et al. | |
| 2010/0038097 | A1 | 2/2010 | Madarapu et al. | |
| 2013/0239673 | A1 | 9/2013 | Garcia-Osuna et al. | |
| 2015/0128705 | A1* | 5/2015 | Daton-Lovett ..... | G01D 11/30 385/12 |

OTHER PUBLICATIONS

International Search Report for International Application No. PCT/US2021/042359 dated Nov. 5, 2021, 6 pages.
International Written Opinion for International Application No. PCT/US21/42359, dated Nov. 5, 2021, 04 pages.

* cited by examiner

DOWN-HOLE TOOLS COMPRISING LAYERS OF MATERIALS AND RELATED METHODS

CROSS-REFERENCE TO RELATED APPLICATION

This application is a continuation of U.S. patent application Ser. No. 16/938,384, filed Jul. 24, 2020, now U.S. Pat. No. 11,434,747, issued Sep. 6, 2022, the disclosure of which is hereby incorporated herein in its entirety by this reference.

TECHNICAL FIELD

This disclosure relates generally to down-hole tools having at least portions formed from a plurality of layers of material joined together (e.g., a coil of material). The disclosure further relates to down-hole tools having at least portions formed from joined layers of material, having openings formed in one or more layers, and having electronics and/or sensors disposed within the openings and/or between layers.

BACKGROUND

Oil wells (wellbores) are usually drilled with a drill string. The drill string includes a tubular member having a drilling assembly that includes a drill bit at its bottom end. The drilling assembly may also include devices and sensors that provide information relating to a variety of parameters relating to the drilling operations ("drilling parameters"), behavior of the drilling assembly ("drilling assembly parameters") and parameters relating to the formations penetrated by the wellbore ("formation parameters"). A drill bit and/or reamer attached to the bottom end of the drilling assembly is rotated by rotating the drill string from the drilling rig and/or by a drilling motor (also referred to as a "mud motor") in the bottom hole assembly ("BHA") to remove formation material to drill the wellbore.

BRIEF SUMMARY

One or more embodiments of the present disclosure include a down-hole tool. The down-hole tool may include at least one wall. The at least one wall may include a plurality of joined parallel layers of material, a plurality of pockets defined within the at least one wall, each pocket of the plurality of pockets including a plurality of openings formed in consecutive layers of the plurality of joined parallel layers of material, and a plurality of recesses defined within the at least one wall and between layers of the plurality of joined parallel layers of material, the plurality of recesses defining at least one conduit. The down-hole tool may include at least one electronic component and/or a sensor or a component of a sensor disposed within a pocket of the plurality of pockets and at least one electrical connection disposed within the at least one conduit.

Further embodiments of the present disclosure include a method of forming a down-hole tool. The method may include providing a sheet of material, forming a plurality of openings through the sheet of material, forming a plurality of recesses in the material, disposing at least one electronic component and/or a sensor or a component of a sensor in the plurality of openings, disposing at least one electrical connection and/or a sensor or a component of a sensor in the plurality of recesses, coiling the sheet of material to form a coiled sheet of material, aligning at least two of the openings of the plurality of opening radially within the coiled sheet of material to define a pocket, and joining adjacent layers of the coiled sheet of material.

Some embodiments of the present disclosure include a down-hole tool. The down-hole tool may include at least one wall. The at least one wall may include a coil of a continuous sheet of material, the coil of the continuous sheet of material defining a plurality of layers, a plurality of pockets defined within the single coil of the continuous sheet of material, each pocket of the plurality of pockets comprising a plurality of openings formed in consecutive layers of the plurality of layers, and a plurality of recesses defined within the single coil of the continuous sheet of material and between layers of the plurality of layers of material, the plurality of recesses defining at least one conduit. The down-hole tool may further include at least one electronic component and/or a sensor or a component of a sensor disposed within a pocket of the plurality of pockets and at least one electrical connection disposed within the at least one conduit.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
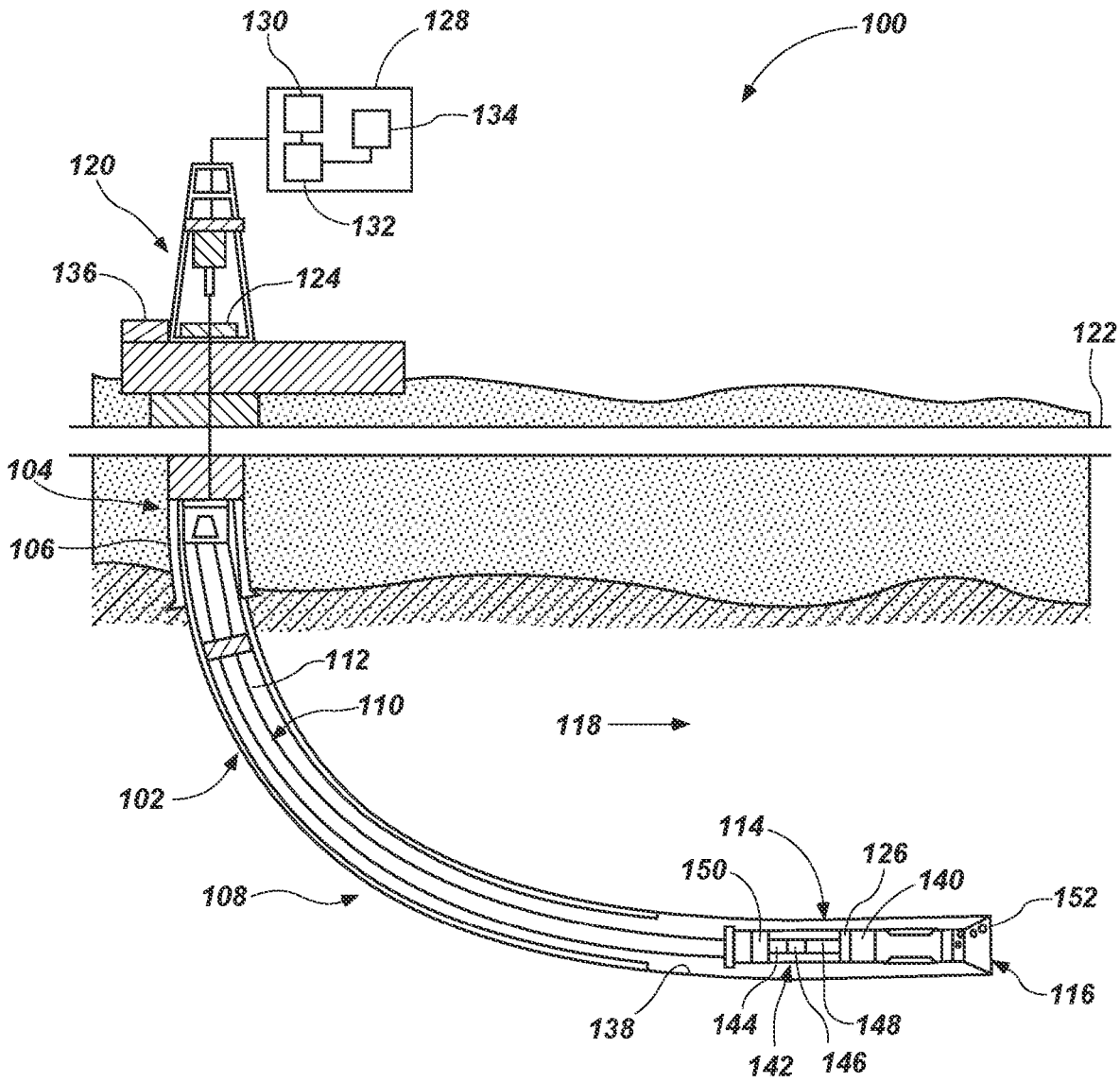
FIG. 1 is a schematic diagram of a wellbore system comprising a drill string that includes one or more sensors according to an embodiment of the present disclosure.

The illustrations presented herein are not actual views of any particular drilling system, drilling tool assembly, or component of such an assembly, but are merely idealized representations, which are employed to describe the present invention.

As used herein, the terms "bit" and "earth-boring tool" each mean and include earth-boring tools for forming, enlarging, or forming and enlarging a wellbore. Non-limiting examples of bits include fixed-cutter ("drag") bits, fixed-cutter coring bits, fixed-cutter eccentric bits, fixed-cutter bicenter bits, fixed-cutter reamers, expandable reamers with blades bearing fixed cutters, and hybrid bits including both fixed cutters and movable cutting structures (roller cones).

As used herein, any relational term, such as "first," "second," "lower," "upper," "outer," "inner," etc., is used for clarity and convenience in understanding the disclosure and accompanying drawings, and does not connote or depend on any specific preference or order, except where the context clearly indicates otherwise.

As used herein, the terms "comprising," "including," "containing," "characterized by," and grammatical equivalents thereof are inclusive or open-ended terms that do not exclude additional, un-recited elements or method steps, but also include the more restrictive terms "consisting of," "consisting essentially of," and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, the term "about" used in reference to a given parameter is inclusive of the stated value and has the meaning dictated by the context (e.g., it includes the degree of error associated with measurement of the given parameter).

FIG. 1 is a schematic diagram of an example of a drilling system 100 that may utilize the down-hole tools and methods disclosed herein for drilling wellbores. FIG. 1 shows a wellbore 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing. A drill bit 116 may be attached to the bottom end of the drilling assembly 114 for drilling the wellbore 102 of a selected diameter in a formation 118.

The drill string 110 may extend to a rig 120 at the surface 122. The rig 120 shown is a land rig 120 for ease of explanation. However, the apparatuses and methods disclosed equally apply when an offshore rig 120 is used for drilling wellbores under water. A rotary table 124 or a top drive may be coupled to the drill string 110 and may be utilized to rotate the drill string 110 and to rotate the drilling assembly 114, and thus the drill bit 116 to drill the wellbore 102. A drilling motor 126 (also referred to as "mud motor") may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the wellbore 102 is drilled.

A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a Flash memory, a magnetic tape, a hard disk, and an optical disc. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside wall 138 of the wellbore 102.

The drilling assembly 114 may further include one or more downhole sensors 140 (collectively designated by numeral 140). The sensors 140 may include any number and type of sensors 140, including, but not limited to, sensors 140 generally known as the measurement-while-drilling (MWD) sensors 140 or the logging-while-drilling (LWD) sensors 140, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank and/or crown of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

The drill bit 116 may include a face section 152 (or bottom section). The face section 152 or a portion thereof may face the undrilled formation 118 in front of the drill bit 116 at the wellbore 102 bottom during drilling. In some embodiments, the drill bit 116 may include one or more cutting elements and, more specifically, a blade projecting from the face section 152.

Figure 2A:
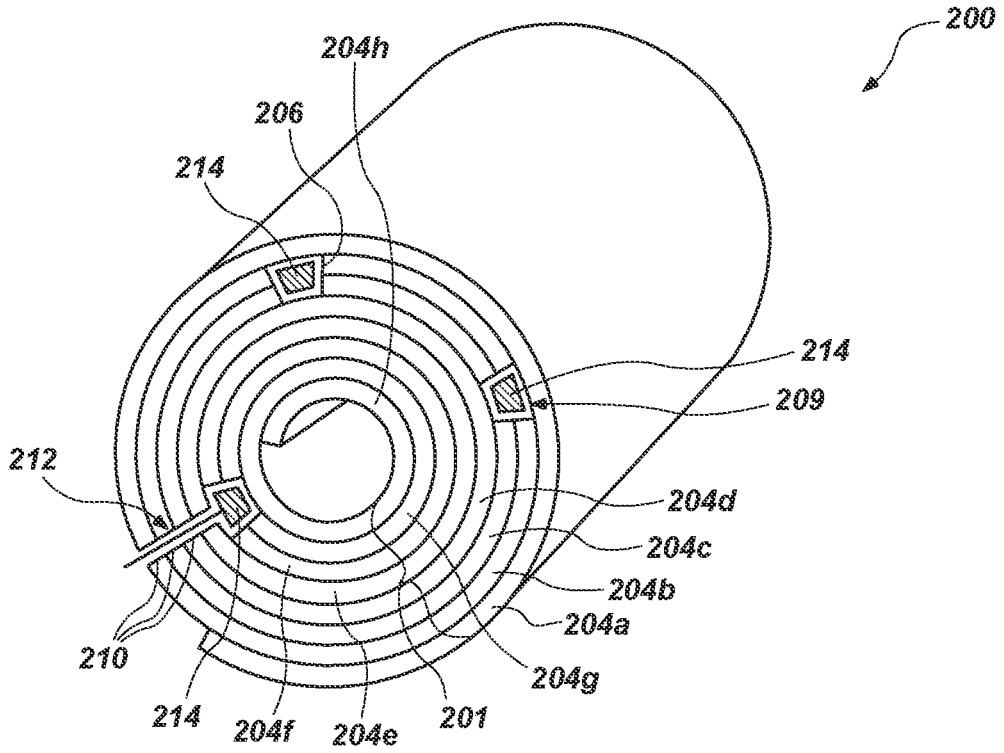
FIG. 2A is a perspective view of at least a section of a down-hole tool for use within a wellbore according to one or more embodiments of the present disclosure of the present disclosure.
Figure 2B:
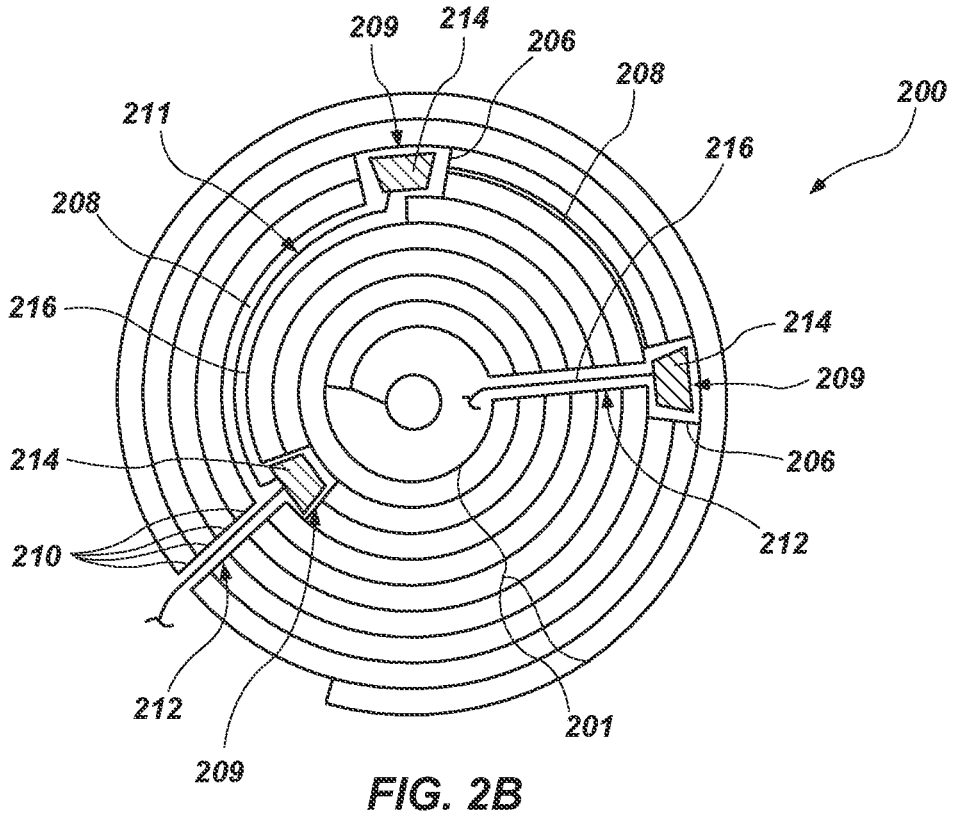
FIG. 2B is a side cross-sectional view of the down-hole tool of FIG. 2A.
Figure 2C:
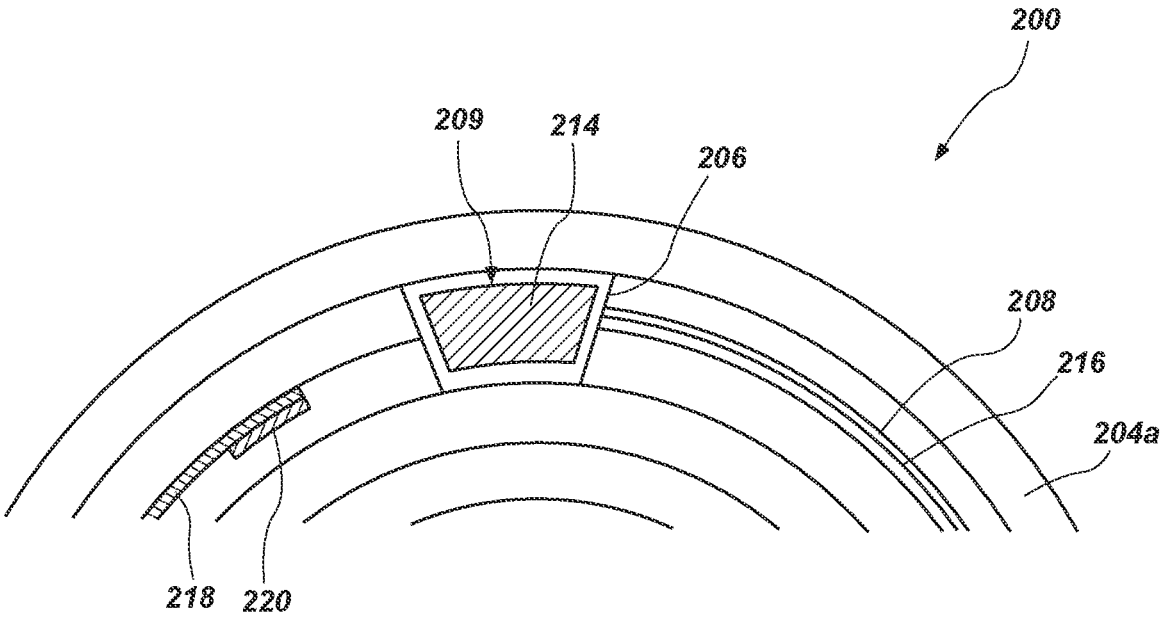
FIG. 2C is an enlarged partial side cross-sectional view of the down-hole tool of FIG. 2A.

FIG. 2A shows a simplified perspective view of a down-hole tool 200 for use within a wellbore according to one or more embodiments of the present disclosure. FIG. 2B is a simplified side cross-sectional view of the down-hole tool 200 of FIG. 2A. FIG. 2C is an enlarged partial side cross-sectional view of the down-hole tool 200 of FIG. 2A. To facilitate description of the embodiments herein, the down-hole tool 200 of FIGS. 2A-2C is simplified, and furthermore, in some embodiments, the down-hole tool 200 depicted in FIGS. 2A-2C may only be a section (i.e., portion) of an overall down-hole tool. Regardless, the description of the down-hole tool 200 herein may refer to an entirety of a given down-hole tool or only a section (i.e., portion) of a given down-hole tool. In some embodiments, the down-hole tool 200 may include one or more of a tubing, MWD tools, LWD tools, portions of a downhole assembly (e.g., a shank), etc.

Referring to FIGS. 2A-2C together, in some embodiments, at least one wall 201 and/or structure element of the down-hole tool 200 may include a plurality of distinct joined layers 204*a*-204*h* of material. For purposes of clarity, a wall 201 of the down-hole tool 200 will be referred to herein as including the plurality of layers 204*a*-204*h*. However, the description of the wall 201 of the down-hole tool 200 may refer to any structural component of a down-hole tool. In one or more embodiments, the wall 201 of the down-hole tool 200 may include a coil of material (e.g., coiled sheet), as depicted in FIG. 2A, with adjacent layers 204*a*-204*h* of the coil being joined together. For example, the layers 204*a*-204*h* of the wall 201 of the down-hole tool 200 may be formed from a single continuous sheet of material wrapped around itself in a coil. Furthermore, the plurality of layers 204*a*-204*h* of the wall 201 may be substantially parallel to each other. For instance, a distance between centerlines of adjacent layers may be at least substantially constant throughout the coil.

In one or more embodiments, the layers 204*a*-204*h* may include steel, stainless steel, aluminum, nickel, copper, titanium, alloys of any of the foregoing materials, and/or any combinations of the foregoing materials. Furthermore, the layers 204*a*-204*h* may include any material available in sheets and/or coiled sheets.

In some embodiments, the layers 204*a*-204*h* may be joined together via welds (e.g., laser beam welds and/or ultrasonic welds) and/or one or more adhesives. In some embodiments, the adhesives may include one or more of an epoxy or a rubber adhesive. Manners of joining the adjacent layers 204*a*-204*h* of the coil are described in greater detail below.

In some embodiments, the adhesives may form adhesive layers between the layers 204*a*-204*h* (e.g., interlayers), and the adhesive layers may isolate the layers 204*a*-204*h* from each other with respect to electrical currents such as, for example, eddy-currents. Additionally, the adhesive layers may at least partially isolate the isolate the layers 204*a*-204*h* from each other with respect to acoustic waves and/or against heat transfer between lays 204*a*-204*h* and through the wall 201.

In one or more embodiments, a distance between adjacent layers (i.e., a thickness of an adhesive between layers) may be within a range of about 0.00 inches and about 0.4 inch. For example, the distance between adjacent layers may be about 0.04 inch.

In some embodiments, the layers 204*a*-204*h* of the wall 201 of the down-hole tool 200 may all have a same thickness T. In one or more embodiments, each layer of the wall 201 of the down-hole tool 200 may have a thickness within a range of about 0.002 inch and about 0.2 inch. For example, each layer of the wall 201 of the down-hole tool 200 may have a thickness of about 0.02 inch. In alternative embodiments, the thicknesses of the layers 204*a*-204*h* of the wall 201 of the down-hole tool 200 may vary.

In some embodiments, the layers 204*a*-204*h* of material may include one or more openings 206 and/or recesses 208 (e.g., grooves) formed (e.g., defined) in the layers 204*a*-204*h*. In one or more embodiments, two or more consecutive (e.g., adjacent) layers 204*a*-204*h* may include openings 206 that are at least partially aligned with each other and define a pocket 209 within the wall 201 of the down-hole tool 200. Although two or more layers 204*a*-204*h* are described as defining a pocket 209, an opening 206 in a single layer may define a pocket 209. Additionally, a single recess 208 or two or more recesses 208 on separate adjacent layers and at least partially aligned with each may define a conduit 211. In some embodiments, the conduits 211 may extend from and between pockets 209. In additional embodiments, the conduits 211 may extend to an exterior surface of the wall 201 of the down-hole tool 200 and/or an inner or exterior surface of the down-hole tool 200.

In some embodiments, the layers 204*a*-204*h* may further include one or more apertures 210, which may be at least partially aligned in consecutive (e.g., adjacent) layers 204*a*-204*h* and may defined pathways 212 extending between layers 204*a*-204*h* of the wall 201. The pathways 212 may also extend to and between pockets 209 and to inner or exterior surfaces of the wall 201 of the down-hole tool 200 and/or to inner or exterior surfaces of the down-hole tool 200. As is described in greater detail below in regard to FIGS. 3A and 3B, the openings 206, recesses 208, and/or the one or more apertures 210 may be mapped prior to coiling the material. Furthermore, the openings 206, recesses 208, and/or the one or more apertures 210 may be formed via one or more of laser cutting, water jet cutting, milling, drilling, and/or punching.

In one or more embodiments, the down-hole tool 200 may include one or more electronic components 214 disposed within the pockets 209 defined by the adjacent openings 206 in the layers 204*a*-204*h*. Furthermore, the down-hole tool 200 may include electrical connections 216 (e.g., wires) disposed within the recesses 208 (i.e., the conduits 211) and/or pathways 212. The electrical connections 216 may extend to the electronic components 214 within the pockets 209 and may extend to other electronic components 214 and/or a controller (e.g., surface control unit 128, a controller unit 142, or another downhole controller).

In some embodiments, the electronic components 214 may be utilized to perform a variety of functions. In some embodiments, the electronic components 214 may include a data analysis system, which may sample data in different sampling modes, sample data at different sampling frequencies, and analyze data. Furthermore, in one or more embodiments, the electronic components 214 may include a power supply, a processor, a memory, a data acquisition systems, and/or at least one sensor for measuring a plurality of parameters related to drilling states, which may include drill string conditions, drill bit conditions, drilling operation conditions, and environmental (e.g., formation) conditions proximate the down-hole tool, drill string, and/or drill bit. In additional embodiments, the electronic components 214 may include a sensor or a component of a sensor such as, for example, a magnetic high permeable material, a piezo electric material, and/or electrically conducting structures. In further embodiments, the electronic components 214 may include an actuator or a component of an actuator such as, for example, magneto-strictive materials, piezo-electric materials, and/or a transmitter coil. In further embodiments, the electronic components 214 may include a power-supply or a component of a power-supply such as, for example, batteries, accumulators, and/or energy-harvesting devices.

Furthermore, the electronic components 214 may include one or more accelerometers, one or more magnetometers, one or more strain gauges, one or more pressure sensors, one or more torque sensors, and/or at least one temperature sensor. Additionally, the electronic components 214 may include any sensors for determining weight-on-bit, cutting element positions, rate of penetration, inclination, azimuth formation/lithology, etc. In further embodiments, the electronic components 214 may include one or more signal generators and correlating receiving sensors. For example, the electronic components 214 may include one or more of a spectrometer, acoustic transceiver, optical transceiver, and/or any other downhole electronic component or sensor. Furthermore, the electronic components 214 may include any of the electronic components and/or sensors described above in regard to FIG. 1. Additionally, the electrical connections 216 may operably couple any of the electronic components and/or sensors described above in regard to FIG. 1 to any of the electronic components 214 disposed in the pockets 209.

As is described in greater detail below, the electronic components 214 may be disposed within the pockets 209 and between layers 204*a*-204*h* during formation of the down-hole tool 200 (e.g., prior to the layers being coiled and joined together).

Referring still to FIGS. 2A-2C, in one or more embodiments, the down-hole tool 200 may include electrical connections 218 (e.g., feed and connection lines) and/or sensors 220 formed between layers 204*a*-204*h*. For example, the electrical connections 218 of the down-hole tool 200 may include one or more sputtered or thin film electrical connections. "Thin film" generally refers to one or more layers of a material having a thickness in the range of fractions of a nanometer to several micrometers. For instance, the electrical connections 218 may be directly deposited on a surface of a given layer (e.g., layer 204*h*) via, e.g., sputtering or other forms of deposition. Additionally, the electrical connections 218 may be operably coupled to one or more electronic components 214 or sensors 220 within the wall 201 of the down-hole tool 200.

In some embodiments, the sensors 220 may include one or more sputtered or thin film sensors. For example, the sensors 220 may include sputtered strain gauges or any other sputtered sensor. For instance, the sensors 220 may include any of the sputtered strain gauges described in U.S. Pat. No. 9,057,247, to Kumar et al., filed Feb. 21, 2012, issued Jun. 16, 2015, U.S. Pat. No. 9,372,124, to Schlosser, filed Jan. 10, 2012, issued Jun. 21, 2016, or U.S. Pat. No. 9,784,099, to Kale et al., filed Dec. 18, 2013, issued Oct. 10, 2017, the disclosures of each of which are incorporated in their entireties by reference herein. In one or more embodiments, one or more of the electrical connections 218 may be operably connected to one or more of the sensors 220.

As is described in greater detail below, the electrical connections 218 and/or the sensors 220 may be deposited directly on surfaces of the layers 204*a*-204*h* such that the electrical connections 218 and/or the sensors 220 are in direct contact with the respective surface of the respective layer. Any of a number of various deposition techniques may be used to deposit the electrical connections 218 and/or the sensors 220 such as sputtering, evaporation, chemical vapor deposition, laser deposition, injection printing, screen printing, ink jet printing, lithographic patterning, electroplating, and others. In view of the foregoing, in some embodiments, the down-hole tool 200 may include a combination of sputtered sensors, sputtered electrical connections, wire connections, and other electronic components.

Figure 3:
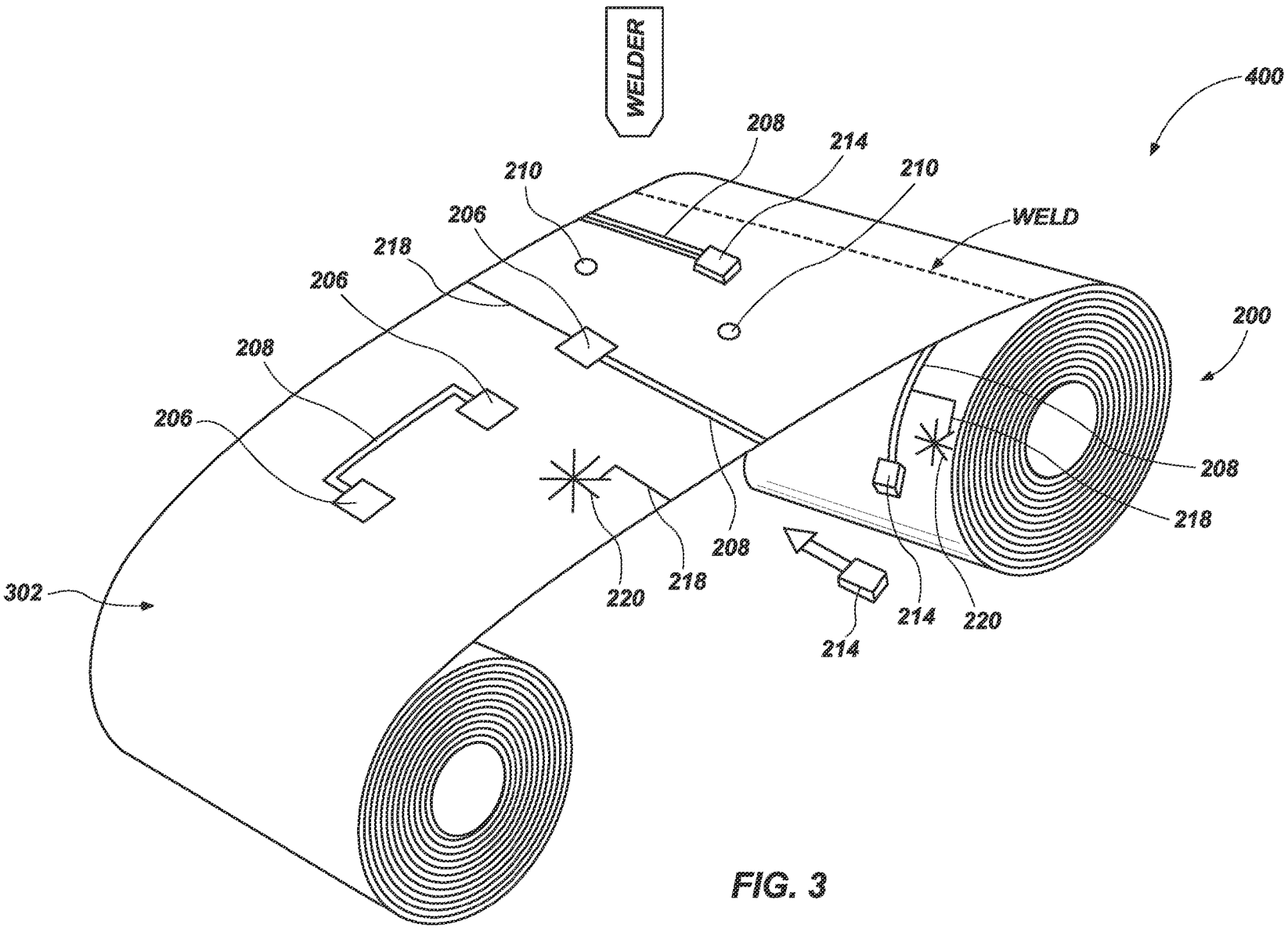
FIG. 3 shows a simplified process for forming a down-hole tool according to one or more embodiments of the present disclosure.
Figure 4:
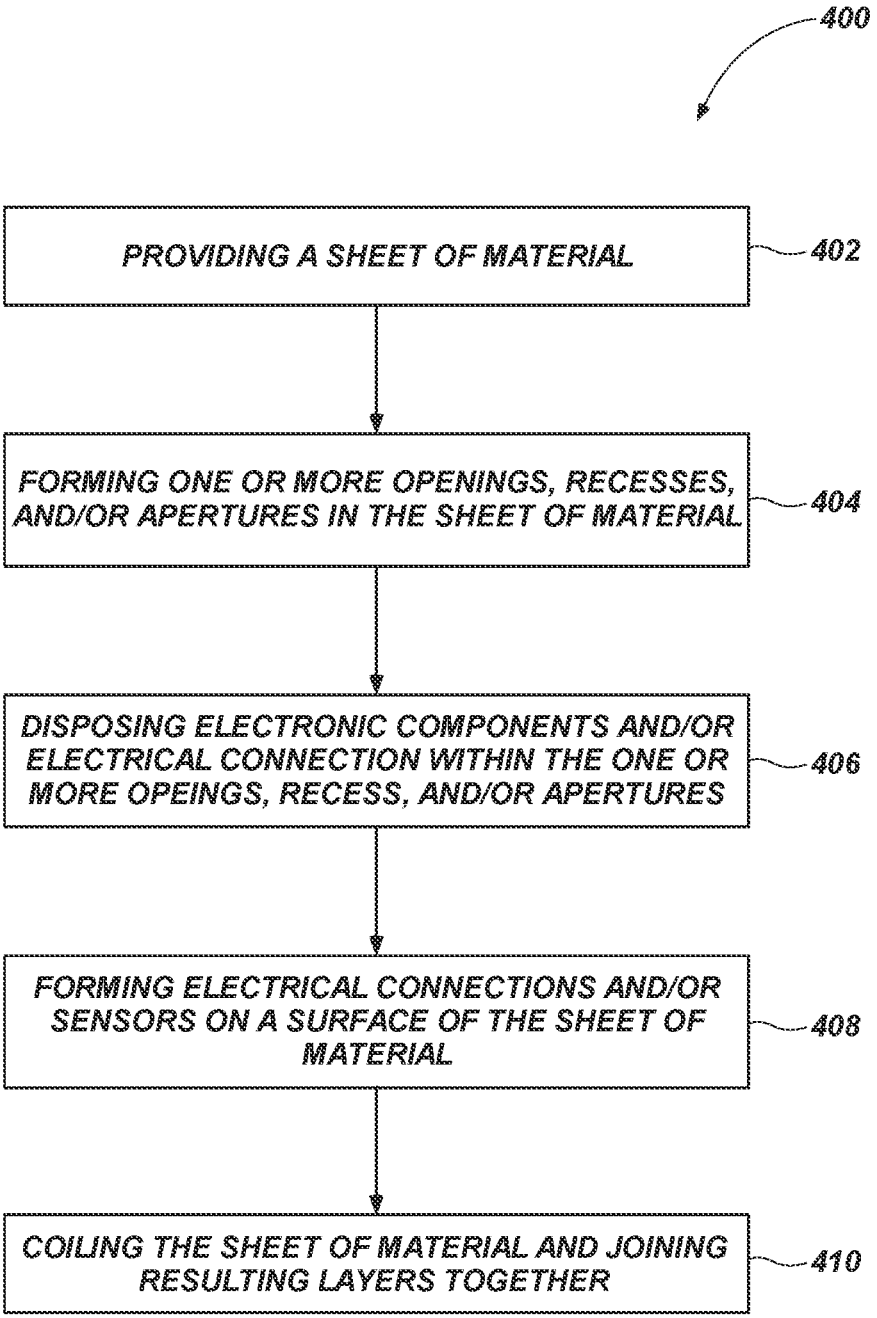
FIG. 4 shows flow chart of a method of forming a down-hole tool according to one or more embodiments of the present disclosure.

FIG. 3 shows a simplified process for forming a down-hole tool for use within a wellbore such as the down-hole tools described above in regard to FIGS. 2A-2C. FIG. 4 shows a flow chart of a method 300 of forming a down-hole tool, such as the down-hole tools described above in regard to FIGS. 2A-2C.

Referring to FIGS. 3 and 4 together, in some embodiments, the method 400 may include providing a sheet 302 of material, as shown in act 402 of FIG. 4. In some embodiments, the sheet 302 of material may include a coiled sheet of material. In further embodiments, the sheet 302 of material may include a plurality of distinct sheets that are joined together. Furthermore, the sheet 302 of material may include any of the materials described above in regard to the layers 204*a*-204*h* of FIGS. 2A-2C. Furthermore, the sheet 302 may include any of the thicknesses described above in regard to FIGS. 2A-2C.

In one or more embodiments, the method 400 may include forming one or more openings 206, recesses 208, and/or apertures 210 in the sheet 302 of material, as shown in act 404 of FIG. 4. In some embodiments, forming one or more openings 206, recesses 208, and/or apertures 210 may include forming the one or more openings 206, recesses 208, and/or apertures 210 via one or more of laser cutting, water jet cutting, punching, or any other conventional methods for cutting and/or recessing material. Furthermore, the one or more openings 206, recesses 208, and/or apertures 210 may be mapped (e.g., designed and formed) on the sheet 302 of material such that when the sheet 302 is rolled upon itself (e.g., coiled) and joined together to form a wall (e.g., wall 201) of a down-hole tool (e.g., down-hole tool 200), openings 206, recesses 208, and/or apertures 210 correlating to a common pocket 209, conduit 211, and/or pathway 212 may align. As a non-limiting example, openings 206 correlating to a same pocket 209 may be mapped on the sheet 302 to align with one another opening 206 when the sheet 302 is rolled upon itself (e.g., coiled) and joined together to form a wall (e.g., wall 201) of a down-hole tool (e.g., down-hole tool 200). Likewise, recesses 208 and apertures 210 correlating to a same conduit 211 or a same pathway 212, respectively, may be mapped on the sheet 302 to align with one another when the sheet 302 is rolled upon itself (e.g., coiled) and joined together to form a wall (e.g., wall 201) of a down-hole tool (e.g., down-hole tool 200). In some embodiments, mapping the openings 206, recesses 208, and/or apertures 210 (e.g., determining distances and spacing between correlating openings 206, recesses 208, and apertures 210 and orienting the correlating openings 206, recesses 208, and apertures 210) to form pockets 209, conduits 211, and/or pathways 212 within the wall 201 of the down-hole tool 200 may account for an ever increasing diameter of the coiled material as the sheet 302 of material is coiled (described below).

In view of the foregoing, in some embodiments, forming the one or more openings 206 in the sheet 302 of material may include forming a first portion (i.e., a first opening) of a pocket 209 in a first region of the sheet 302 of material, and forming (e.g., subsequently forming) a second portion (i.e., a second opening) of the pocket 209 in a second, different region of the sheet 302 (e.g., the same sheet 302). Likewise, forming the apertures 210 in the sheet 302 of material may include forming a first portion (i.e., a first aperture) of a pathway 212 in a first region of the sheet 302 of material, and forming (e.g., subsequently forming) a second portion (i.e., a second aperture) of the pathway 212 in a second, different region of the sheet 302 (e.g., the same sheet 302). Furthermore, forming the recesses 208 in the sheet 302 of material may include forming a first portion (i.e., a first recess) of a conduit 211 in a first region of the sheet 302 of material, and forming (e.g., subsequently forming) a second portion (i.e., a second recess) of the conduit 211 in a second, different region of the sheet 302 (e.g., the same sheet 302). In some embodiments, each subsequently-formed opening 206, recess 208, or aperture 210 of a given pocket 209, conduit 211, or pathway 212, respectively, may correlate to a portion of the respective pocket 209, recess 208, or pathway 212 that is radially further from a longitudinal axis of the down-hole tool 200 relative to a previously-formed opening 206, recess 208, or aperture 210 of the given pocket 209, conduit 211, or pathway 212, respectively.

The method 400 may further include disposing electronic components 214 and/or electrical connections 216 (e.g., wires) within the openings 206, recesses 208 (i.e., conduits 211), and/or apertures 210 (or pathways 212), as shown in act 406 in FIG. 4. For example, act 406 may include disposing any of the electronic components 214 and/or electrical connections 216 described above in regard to FIGS. 2A-2C. In some embodiments, the electronic components 214 and/or electrical connections 216 may be secured within the pockets 209, the (i.e., conduits 211), and/or the pathways 212 via an adhesive and/or fasteners. For example, the electronic components 214 and/or electrical connections 216 may be secured via a cement.

In some embodiments, the method 400 may optionally include forming electrical connections 218 (e.g., feed and connection lines) and/or sensors 220 on a surface of the sheet 302 of material, as shown in act 408 of FIG. 4. In one or more embodiments, act 408 may include forming sputtered and/or thin film electrical connections 218 and/or sensors 220. For example, act 408 may include directly depositing the electrical connections 218 and/or sensors 220 on the surface (e.g., a major surface) via sputtering, evaporation, chemical vapor deposition, laser deposition, injection printing, screen printing, ink jet printing, lithographic patterning, electroplating and others. Furthermore, the electrical connections 218 and sensors 220 may include any of the electrical connections 218 and sensors 220 described above in regard to FIGS. 2A-2C.

Upon deposition of electronic components 214 and/or electrical connections 216 within the sheet 302 of material and/or forming electrical connections and/or sensors 220 on a surface of the sheet 302, the method may include coiling (e.g., rolling) the sheet 302 of material and joining resulting layers (e.g., layers 204*a*-204*h*) together, as shown in act 410 of FIG. 4.

In some embodiments, coiling the sheet 302 of material may include forming a hollow cylinder with the sheet 302 of material. For instance, coiling the sheet 302 of material may include wrapping the sheet 302 of material about a body to form the hollow cylinder. However, coiling the sheet 302 may include any conventional methods of coiling materials.

In some embodiments, joining the resulting layers (e.g., layers 204*a*-204*h*) of the sheet 302 of material together may occur at least substantially simultaneously with coiling the sheet 204 of material. In one or more embodiments, joining the resulting layers (e.g., layers 204*a*-204*h*) of the sheet 302 of material together may include joining the layers of the sheet 302 of material together via one or more of laser beam welding (e.g., electron-beam welding) or ultrasonic welding or resistance welding. For instance, the layers of the sheet 302 of material may be joined together via a continuous or pulsed laser process or by applying ultrasonic acoustic vibrations to the sheet 302 of material while under pressure to create solid-state welds.

In further embodiments, joining the resulting layers (e.g., layers 204*a*-204*h*) of the sheet 302 of material together may include applying an adhesive and joining the layers via the adhesive. In some embodiments, the adhesive may include epoxy and/or a rubber adhesive. For instance, any conventional epoxy and/or rubber adhesive viable for downhole applications may be used to join the layers. For example, the adhesive may include PERMABOND.

In one or more embodiments, joining the layers together via the manners described herein may result in a hermetically sealed down-hole tool. For instance, joining the layer together may provide an airtight down-hole tool.

Down-hole tools (e.g., down-hole tool 200) and forming down-hole tools via the methods described herein may provide advantages over conventional down-hole tools and methods of forming conventional down-hole tools. For example, forming pockets 209 by forming openings 206 in a sheet (e.g., 402) of material and coiling the sheet (e.g., sheet 302) material to form the down-hole tool (e.g., down-hole tool 200) may provide pockets 209 having a tighter (e.g., accurate) fit for electronic components (e.g., electronic components 214) within the pockets 209. As a result, electronic components of down-hole tools of the present disclosure may be subjected to less vibrational impact in comparison to conventional down-hole tools. Subjecting electronic components to less vibrational impact may result in more reliable down-hole tools and longer lifespans of down-hole tools.

In some embodiments, forming pockets 209 within a wall of a down-hole tool (e.g., down-hole tool 200) by forming openings 206 in a sheet (e.g., 402) of material and coiling the sheet (e.g., sheet 302) material to form the down-hole tool may increase an amount of viable space for electronics within the down-hole tool and may allow more complex geometries of electronic components and connections in comparison to conventional down-hole tools. Moreover, forming pockets 209 within a wall of a down-hole tool (e.g., down-hole tool 200) by forming openings 206 in a sheet (e.g., 402) of material and coiling the sheet (e.g., sheet 302) material to form the down-hole tool may reduce an amount of affected portions of the down-hole tool in disposing electronic components and connection within the down-hole tool. For instance, the down-hole tools and methods described herein remove any need to cut into a formed down-hole tool to dispose electronics and subsequently welding and/or fastening covers, hatches, and/caps over the recesses and electronics, which affects the entire area around the cut (e.g., recesses) and welds and can reduce integrity of (e.g., weaken) those areas (e.g., mechanical structure) of the down-hole tool.

Furthermore, the down-hole tools of the present disclosure may provide "no maintenance" down-hole tools that are merely replaced as a whole when necessary. Moreover, forming the down-hole tools from coiled sheets of material in comparison to conventional methods (e.g., turning, milling, drilling, etc.) may utilize a more readily available material, may reduce costs, and may reduce overall production time.

Additionally, joining the layers (e.g., layers 204*a*-204*h*) of the down-hole tool together in the manners described herein may eliminate any need for conventional O-rings for sealing the down-hole tool. Furthermore, disposing thin layers of adhesive (e.g., rubber) between the layers (e.g., layers 204*a*-204*h*) of the down-hole tool may provision torsional damping for the down-hole tool.

Figure 5:
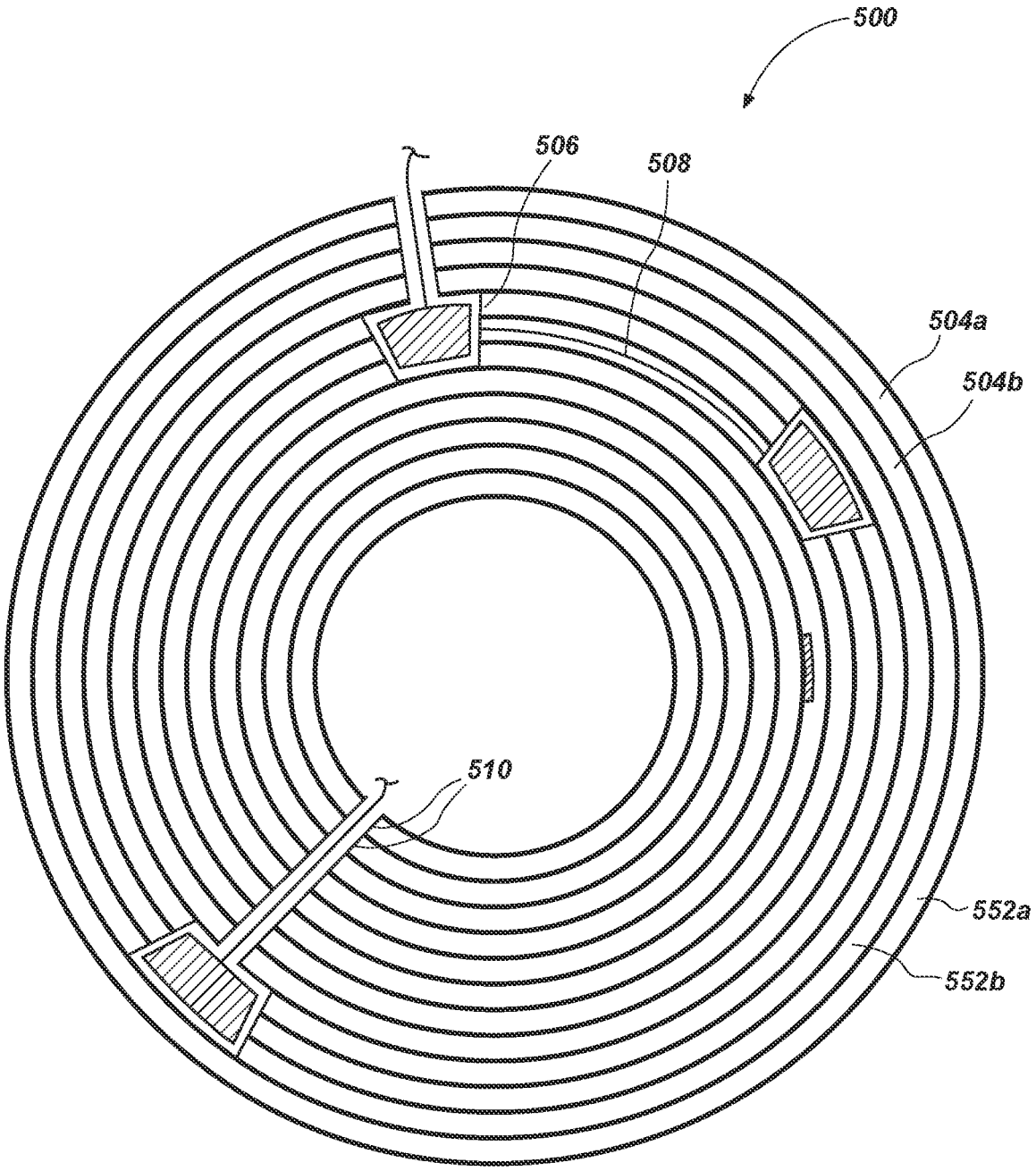
FIG. 5 is a side cross-section view of a down-hole tool according to one or more embodiments of the present disclosure.

FIG. 5 is a simplified side cross-sectional view of a down-hole tool 500 for use within a wellbore according to one or more embodiments of the present disclosure. Similar to the down-hole tool 200 of FIGS. 2A-2C, the down-hole tool 500 may include a plurality of layers 504*a*-504*n*. However, instead of a continuous sheet of material (e.g., a coil of material) forming the layers, the down-hole tool 500 includes a plurality of concentric hollow cylinders 552*a*-552*n* defining the plurality of layers 504*a*-504*n*. In some embodiments, the openings 506, recesses 508, and apertures 510 may be formed via the same manners as described above. In some embodiments, the openings 506, recesses 508, and apertures 510 may be formed on respective hollow cylinders after the cylinders are formed. In other embodiments, the openings 506, recesses 508, and apertures 510 may be formed in a sheet of material, the sheet of material may be cut into sections and formed into the plurality of hollow cylinders 552*a*-552*n*.

Figure 6A:
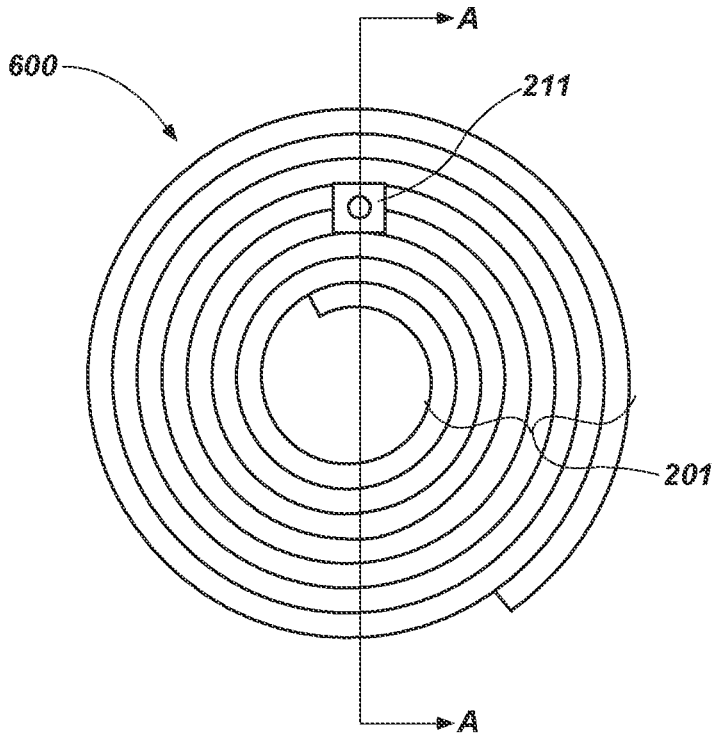
FIG. 6A shows a simplified side cross-sectional view of a down-hole tool having a conduit formed therein according to one or more embodiments of the present disclosure.
Figure 6B:
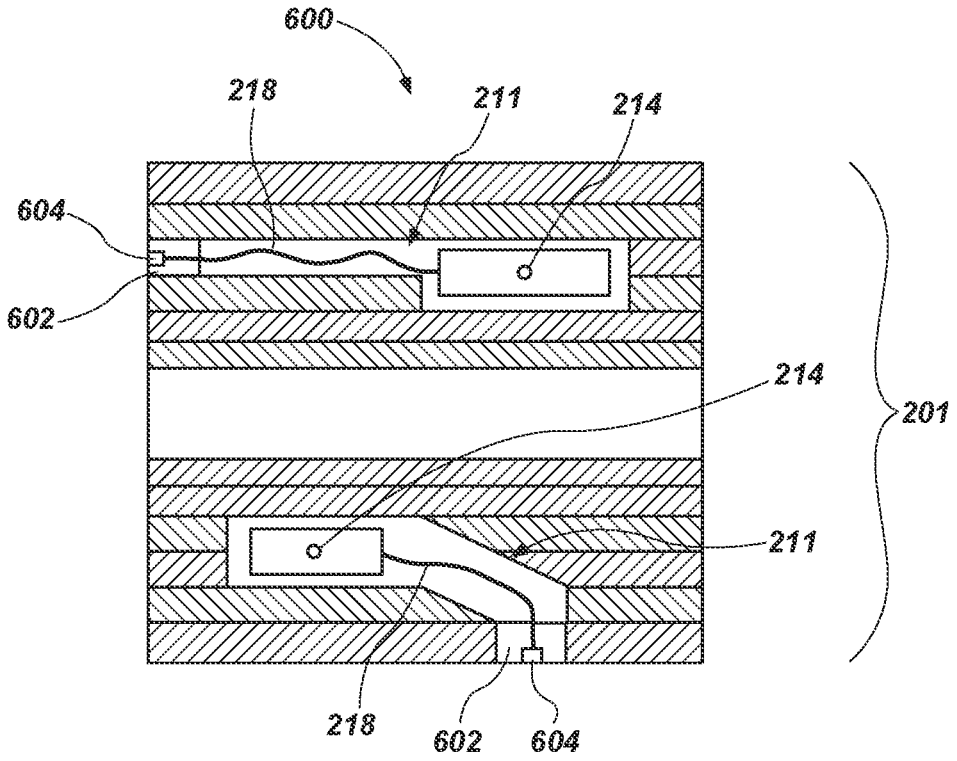
FIG. 6B shows a simplified cross-sectional view of the down-hole tool of FIG. 6A along the plane A-A according to one or more embodiments of the present disclosure.

FIG. 6A shows a simplified side cross-sectional view of a down-hole tool 600 having a conduit formed therein according to one or more embodiments of the present disclosure. FIG. 6B shows a simplified cross-sectional view of the down-hole tool of FIG. 6A along the plane A-A according to one or more embodiments of the present disclosure. The down-hole tool 600 may include conduit 211 form therein. For instance, the down-hole tool 600 may include any of the openings and/or recesses described above formed in layers of the down-hole tool 600. Furthermore, the down-hole tool 600 may include a feed-through plug 602 disposed at an interface of the conduit 211 (e.g., recesses and/or apertures) an external or internal boundary of the wall 201. For instance, the down-hole tool 600 may include a welded feed-through plug 602 at an external or internal boundary of the wall 201. Additionally, the down-hole tool 600 may include a welded feed-through plug 602 may include a feed-through plug 602 at any interface that may be exposed to conditions and/or environments from which an associated electronic component 214 is to be protected. The feed-through plug 602 may permit an electrical connection 218 to pass therethrough while otherwise sealing an associated conduit 211 (e.g., recesses and/or apertures). In some embodiments, the welded feed-through plug 602 may include an electrical connector 604 (e.g., socket, plug, etc.) for connecting to another electrical connection. Furthermore, any of the downhole tools described herein may include any number of the above-described feed-through plugs 602 in any of the recesses, apertures, conduits, etc., to seal and protect electronic components within the down-hole tool 600.

Embodiments of the present disclosure further include drilling at least a portion of a borehole (FIG. 1) with one or more of the down-hole tools described herein.

Embodiments of the present disclosure further include the following embodiments.

Embodiment 1: A down-hole tool for use within a wellbore, comprising: at least one wall comprising: a plurality of joined parallel layers of material; a plurality of pockets defined within the at least one wall, each pocket of the plurality of pockets comprising a plurality of openings formed in consecutive layers of the plurality of joined parallel layers of material; and a plurality of recesses defined within the at least one wall and between layers of the plurality of joined parallel layers of material, the plurality of recesses defining at least one conduit; at least one electronic component disposed within a pocket of the plurality of pockets; and at least one electrical connection disposed within the at least one conduit.

Embodiment 2: The down-hole tool of embodiment 1, wherein the plurality of joined parallel layers of material comprise a single coiled sheet of material.

Embodiment 3: The down-hole tool of embodiment 1, wherein the plurality of joined parallel layers of material comprise a plurality of concentric hollow cylinders of material.

Embodiment 4: The down-hole tool of any one of embodiments 1 through 3, wherein a distance between adjacent layers of the plurality of parallel layers is within a range of about 0.00 inches and 0.04 inch.

Embodiment 5: The down-hole tool of any one of embodiments 1 through 4, wherein each layer of the plurality of parallel layers has a same thickness.

Embodiment 6: The down-hole tool of any one of embodiments 1 through 5, further comprising at least one of a sputtered sensor or sputtered electrical connection formed between one or more adjacent layers of the plurality of parallel layers.

Embodiment 7: The down-hole tool of any one of embodiments 1 through 6, further comprising at least one sputtered strain gauge formed between one or more adjacent layers of the plurality of parallel layers.

Embodiment 8: The down-hole tool of any one of embodiments 1 through 7, further comprising an adhesive disposed between and joining adjacent layers of the plurality of parallel layers.

Embodiment 9: The down-hole tool of any one of embodiments 1 through 7, further comprising a rubber material disposed between and joining adjacent layers of the plurality of parallel layers.

Embodiment 10: The down-hole tool of any one of embodiments 1 through 7, wherein the layers of the plurality of parallel layers are joined together via one or more of ultrasonic welding or laser welding or e-beam welding or resistance welding.

Embodiment 11: The down-hole tool of any one of embodiments 1 through 10, wherein the at least one electronic component comprises one or more of an accelerometer, a magnetometer, a strain gauge, a pressure sensor, a torque sensors, a temperature sensor, a magnetic high permeable material, a piezo-electric material, or an optical transparent material.

Embodiment 12: A method of forming a down-hole tool, the method comprising: providing a sheet of material; forming a plurality of openings through the sheet of material; forming a plurality of recesses in the material; disposing at least one electronic component in the plurality of openings; disposing at least one electrical connection in the plurality of recesses; coiling the sheet of material to form a coiled sheet of material; aligning at least two of the openings of the plurality of opening radially within the coiled sheet of material to define a pocket; and joining adjacent layers of the coiled sheet of material.

Embodiment 13: The method of embodiment 12, wherein joining adjacent layers of the coiled sheet of material comprises welding the adjacent layers together via one or more of a laser welding technique or ultrasonic welding technique or e-beam welding or resistance welding.

Embodiment 14: The method of embodiment 12, wherein joining adjacent layers of the coiled sheet of material comprises disposing an adhesive between the adjacent layers.

Embodiment 15: The method of any one of embodiments 12 through 14, further comprising: sputtering at least one of a sensor or electrical connection on the sheet of material; and coiling the sheet of material to orient the at least one of a sensor or electrical connection between adjacent layers of the coiled sheet of material.

Embodiment 16: The method of any one of embodiments 12 through 15, wherein forming the plurality of openings comprises forming the plurality of openings via one or more of laser cutting, water jet cutting, or punching.

Embodiment 17: The method of any one of embodiments 12 through 16, wherein disposing at least one electronic component in the plurality of openings comprises disposing at least one of an accelerometer, a magnetometer, a strain gauge, a pressure sensor, a torque sensor, a temperature sensor, a power supply, a component of a power supply, an actuator, or a component of an actuator comprising a magneto-strictive material, a piezo-electric material, or an electromagnetic coil within the plurality of openings.

Embodiment 18: The method of any one of embodiments 12 through 17, further comprising drilling at least a portion of a borehole with the down-hole tool.

Embodiment 19: A down-hole tool, comprising: at least one wall comprising: a coil of a continuous sheet of material, the coil of the continuous sheet of material defining a plurality of layers; a plurality of pockets defined within the coil of the continuous sheet of material, each pocket of the plurality of pockets comprising a plurality of openings formed in consecutive layers of the plurality of layers; and a plurality of recesses defined within the coil of the continuous sheet of material and between layers of the plurality of layers of material, the plurality of recesses defining at least one conduit; at least one electronic component disposed within a pocket of the plurality of pockets; and at least one electrical connection disposed within the at least one conduit.

Embodiment 20: The down-hole tool of embodiment 19, further comprising an adhesive disposed between and joining adjacent layers of the plurality of layers.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. A down-hole tool for use in a wellbore, comprising:

at least one wall comprising:

a coil of a continuous sheet of material, the coil of the continuous sheet of material defining a plurality of layers;

at least one pocket defined within the coil of the continuous sheet of material, the at least one pocket comprising a plurality of openings formed in consecutive layers of the plurality of layers; and at least one conduit defined within the coil of the continuous sheet of material, the at least one conduit comprising at least one recess formed in at least one of the layers of the plurality of layers;

at least one electronic component disposed within the at least one pocket; and at least one electrical connection disposed within the at least one conduit.

2. The down-hole tool of claim 1, further comprising an adhesive disposed between and joining consecutive layers of the plurality of layers.

3. The down-hole tool of claim 1, further comprising an aperture defined within the coil of the continuous sheet of material, the aperture defining a pathway extending between the at least one pocket and an exterior surface of the wall.

4. The down-hole tool of claim 1, wherein the continuous sheet of material comprises one of stainless steel, aluminum, nickel, copper, and titanium.

5. The down-hole tool of claim 1, wherein a distance between consecutive layers of the plurality of layers is within a range of about 0.00 inches and 0.04 inch.

6. The down-hole tool of claim 1, wherein each layer of the plurality of layers has a same thickness.

7. The down-hole tool of claim 1, further comprising at least one of a sputtered sensor or sputtered electrical connection formed between consecutive layers of the plurality of layers.

8. The down-hole tool of claim 1, further comprising at least one sputtered strain gauge formed between consecutive layers of the plurality of layers.

9. The down-hole tool of claim 1, further comprising a rubber material disposed between and joining consecutive layers of the plurality of layers.

10. The down-hole tool of claim 1, wherein consecutive layers of the plurality of layers are joined together via one or more of ultrasonic welding, laser welding, e-beam welding, or resistance welding.

11. The down-hole tool of claim 1, wherein the at least one electronic component comprises one or more of an accelerometer, a magnetometer, a strain gauge, a pressure sensor, a torque sensors, a temperature sensor, a magnetic high permeable material, a piezo-electric material, or optical transparent material.

12. A method of forming a down-hole tool for use in a wellbore, the method comprising:

providing a sheet of material;

forming a plurality of openings through the sheet of material;

forming at least one recess in the sheet of material;

disposing at least one electronic component in the plurality of openings;

disposing at least one electrical connection in the at least one recess;

coiling the sheet of material to form a coiled sheet of material; and aligning at least two of the openings of the plurality of openings radially within the coiled sheet of material to define a pocket.

13. The method of claim 12, further comprising joining adjacent layers of the coiled sheet of material.

14. The method of claim 13, wherein joining adjacent layers of the coiled sheet of material comprises welding the adjacent layers together via one or more of a laser welding technique, ultrasonic welding technique, e-beam welding technique, or resistance welding technique.

15. The method of claim 13, wherein joining adjacent layers of the coiled sheet of material comprises disposing an adhesive between the adjacent layers.

16. The method of claim 12, further comprising:

sputtering at least one of a sensor or electrical connection on the sheet of material; and wherein the coiling the sheet of material comprises orienting the at least one of a sensor or electrical connection between adjacent layers of the coiled sheet of material.

17. The method of claim 12, wherein forming the plurality of openings comprises forming the plurality of openings via one or more of laser cutting, water jet cutting, or punching.

18. The method of claim 12, wherein disposing at least one electronic component in the plurality of openings comprises disposing at least one of an accelerometer, a magnetometer, a strain gauge, a pressure sensor, a torque sensor, a temperature sensor, a power supply, a component of a power supply, an actuator, or a component of an actuator comprising a magneto-strictive material, a piezo-electric material, or an electromagnetic coil within the plurality of openings.

19. The method of claim 12, further comprising drilling at least a portion of the wellbore with the down-hole tool.

20. A down-hole tool for use within a wellbore, comprising:

at least one wall comprising:

a plurality of concentric hollow cylinders of material;

at least one pocket defined within the at least one wall, the at least one pocket comprising a plurality of openings formed in at least three consecutive concentric hollow cylinders of material of the plurality of concentric hollow cylinders of material; and at least one conduit defined within the at least one wall, the at least one conduit comprising at least one recess formed in at least one concentric hollow cylinder of material of the plurality of concentric hollow cylinders of material;

at least one electronic component disposed within the at least one pocket; and at least one electrical connection disposed within the at least one conduit.

21. The down-hole tool of claim 20, wherein the at least one electronic component is positioned within at least two openings of the plurality of openings.

* * * * *